United States Patent [19]

Jencks et al.

[11] 4,001,742

[45] Jan. 4, 1977

[54] CIRCUIT BREAKER HAVING IMPROVED OPERATING MECHANISM

[75] Inventors: Charles L. Jencks, Avon; Roger N. Castonguay, Bristol, both of Conn.

[73] Assignee: General Electric Company, New York, N.Y.

[22] Filed: Oct. 30, 1975

[21] Appl. No.: 627,149

[52] U.S. Cl. ..... 335/173; 335/191; 200/153 G

[51] Int. Cl.[2] ..... H01H 9/20; H01H 3/46

[58] Field of Search ..... 335/18, 20, 22, 25, 335/27, 34, 38, 169, 170, 173, 191; 200/50 A, 153 G

[56] References Cited

UNITED STATES PATENTS

| | | | |
|---|---|---|---|
| 3,368,053 | 2/1968 | Groves | 200/50 A X |
| 3,377,574 | 4/1968 | Brumfield et al. | 335/27 |
| 3,492,614 | 1/1970 | DeAngelo et al. | 335/191 |
| 3,783,215 | 1/1974 | Brumfield | 200/153 G |
| 3,849,751 | 11/1974 | Link et al. | 200/153 G |

*Primary Examiner*—George Harris
*Attorney, Agent, or Firm*—Robert A. Cahill; Walter C. Bernkopf; Frank L. Neuhauser

[57] ABSTRACT

A circuit breaker includes an operating mechanism having powerful mechanism springs to achieve the requisite contact pressures for high current carrying capacity. A single crank of a rotary handle through a relatively small arc of 120° resets the operating mechanism via a reciprocating slide and a latching mechanism, while loading the mechanism springs. Return of the handle to its original position shifts the line of action of the springs such as to abruptly straighten a toggle and achieve rapid closure of the circuit breaker contacts. The latching mechanism is equipped with plural circuit breaker tripping capabilities, together with a lockout and bell alarm switch accessory.

10 Claims, 17 Drawing Figures

CIRCUIT BREAKER HAVING IMPROVED OPERATING MECHANISM

BACKGROUND OF THE INVENTION

The present invention relates to electric circuit breakers and, more particularly, to novel operating and latching mechanisms for facilitating manual and automatic operation of electric circuit breakers designed to carry relatively high currents.

Automatic electric circuit breakers of relatively high current carrying capacity must necessarily utilize rather large movable contact arm assemblies to carry the current. Moreover, substantial contact pressure must be exerted on the movable contact arms by rather powerful mechanism springs in order to achieve intimate electrical contacting engagement between the fixed and movable contacts of the circuit breaker. Powerful mechanism springs also must be used to achieve abrupt separation of the circuit breaker contacts for requisite high interrupting capacity.

Such powerful mechanism springs pose difficulties to the user in manually articulating the operating mechanism to its reset condition, thus loading the mechanism springs incident to reclosing the circuit breaker. To facilitate manual circuit breaker operation, various mechanical mechanisms interfacing the operating handle and the operating mechanism have been proposed to afford some degree of mechanical advantage. Such mechanical mechanisms have in the past typically been cumbersome to operate, bulky and/or expensive to manufacture.

It is accordingly an object of the present invention to provide an electric circuit breaker of relatively high current carrying capacity which utilizes a relatively compact and simplified operating mechanism readily conducive to manual articulation against the bias of powerful operating mechanism springs.

An additional object of the invention is to provide a circuit breaker of the above character, wherein the operating mechanism thereof is readily articulated via a rotary operating handle.

A further object is to provide a circuit breaker of the above character, wherein resetting of the operating mechanism against the bias of powerful mechanism springs is achieved via a single crank of the rotary handle through a relatively small angle.

Yet another object of the present invention is to provide a circuit breaker of the above character, which includes an improved latching mechanism capable of accommodating a variety of manually and automatically initiated trip functions.

An additional object of the present invention is to provide a circuit breaker of the above character, which is inexpensive to manufacture, compact, and efficient in both its manual and automatic operating modes.

Other objects of the invention will in parts be obvious and in part appear hereinafter.

SUMMARY OF THE INVENTION

In accordance with the present invention, there is provided an automatic electric circuit breaker having a rotary handle operatively connected to reciprocate an operating slide such as to reset the operating mechanism against the bias of relatively powerful mechanism springs with a single forward stroke of the slide and close the circuit breaker contacts with a single return stroke thereof. To thusly reciprocate the slide, the handle need be cranked through an angle of a mere 120°. The slide is operably connected to pivot an operating lever which, in turn, pivots a cradle around to a position where it can be latchably engaged by a primary latch of a latching mechanism to reset the operating mechanism. The cradle is connected to a movable contact arm by a toggle linkage. The mechanism springs are connected between the knee of the toggle linkage and the operating lever such that pivotal movement of the operating lever in the mechanism resetting direction loads the mechanism springs. During the return stroke of the slide, the operating lever is also pivoted in a return direction to shift the line of action of the mechanism springs. Ultimately the springs are effective to abruptly straighten the toggle linkage, forcing the movable contact arm to a closed circuit position.

Tripping of the circuit breaker, either manually or automatically, causes the latching mechanism primary latch to release the cradle and the springs abruptly collapse the toggle linkage to pivot the movable contact arms to their open circuit positions. To facilitate tripping of the circuit breaker, the latching mechanism utilizes a secondary latch to releasably sustain the primary latch in latching engagement with the cradle. Manual tripping of the circuit breaker is effected by acting on the secondary latch either via the handle and slide or an external trip button. Automatic tripping of the circuit breaker is effected by acting on the secondary latch via a shunt trip solenoid energized under the control of an electronic trip unit. The shunt trip solenoid is in the form of a flux shifter which is reset automatically under the control of the slide incident to resetting of the operating mechanism.

The invention accordingly comprises the features of construction, combination of elements, and arrangement of parts which will be exemplified in the construction hereinafter set forth, and the scope of the invention will be indicated in the claims.

For a fuller understanding of the nature and objects of the invention, a reference should be had to the following detailed description taken in connection with the accompanying drawings, in which.

Corresponding reference numerals refer to like parts throughout the several views of the drawings.

DETAILED DESCRIPTION

Figure 1:
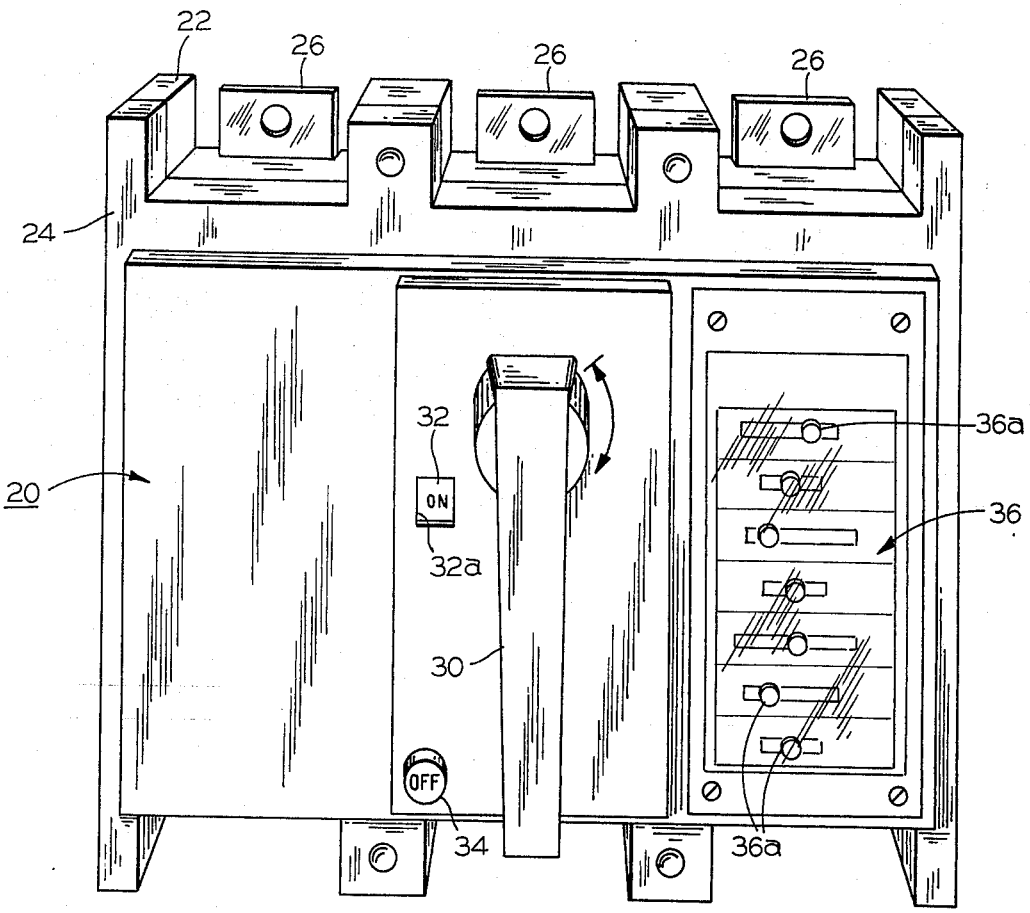
FIG. 1 is an isometric view of an electric circuit breaker embodying the present invention.

Referring now to the drawings, there is illustrated in FIG. 1 an industrial circuit breaker embodying the invention and having an insulative case, generally indicated at 20, consisting of a base 22 and a cover 24. Line terminal straps 26, one for each pole of the circuit breaker, are brought out for disposition in recesses provided in the top of the circuit breaker case. Similarly, load terminal straps 28 (FIG. 2) are located in recesses provided in the bottom of the circuit breaker case. A rotary handle 30 coupled to an operating mechanism within the case through cover 24 facilitates manual operation of the circuit breaker. Since the position of handle 30 is not conclusively indicative of the condition of the circuit breaker, a flag 32, linked to the operating mechanism and visible through an opening **32*a* in the cover, identifies whether the circuit breaker contacts are open or closed. A trip button 34 protruding through cover 24 may be depressed to manually trip the circuit breaker from its closed circuit condition to its open circuit condition. Also accessible through cover 24 is an electronic trip unit, generally indicated at 36, featuring a plurality of adjustable controls 36*a*** for conveniently setting the desired overcurrent parameters, overcurrent magnitude and time delay, for automatic tripping of the circuit breaker.

Figure 2:
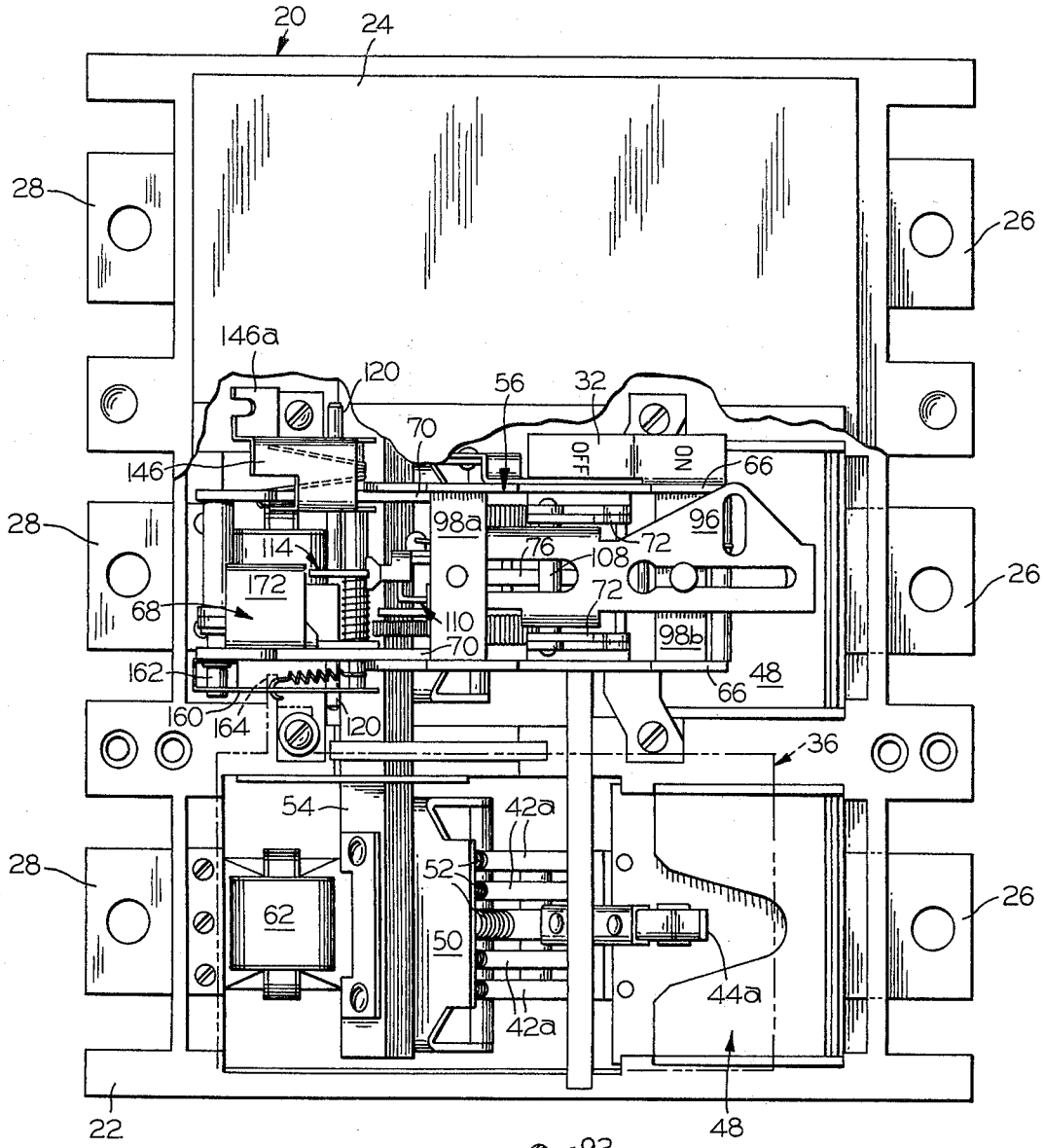
FIG. 2 is a plan view of the circuit breaker of FIG. 1 with the cover partially broken away.
Figure 3:
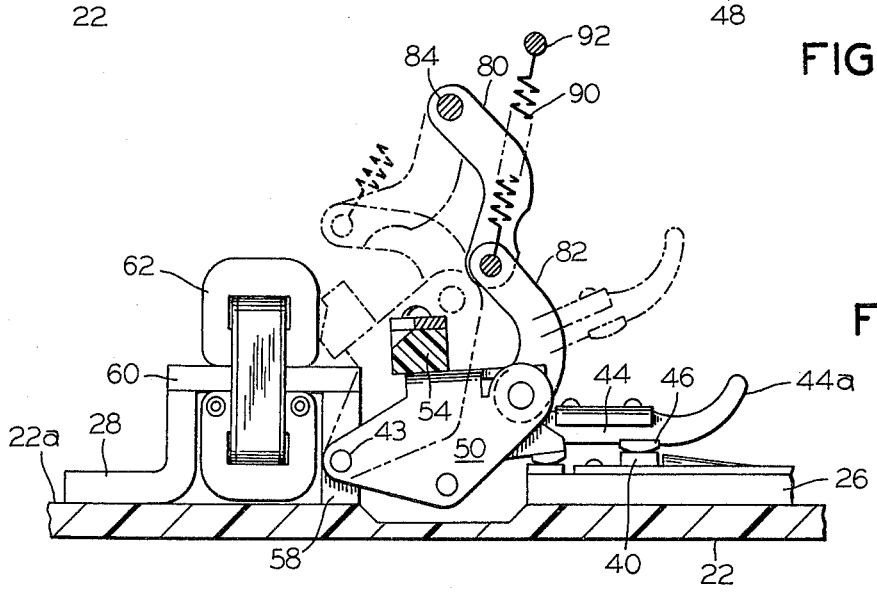
FIG. 3 is a simplified, side elevational view illustrating the internal circuit through the center pole of the circuit breaker of FIG. 1.

As best seen in FIGS. 2 and 3, right terminal strap 26 for each pole of the circuit breaker is affixed to the floor **22*a* of the base 22 and carries adjacent to its inner end a transverse array of stationary main contacts 38 and a single stationary arcing contact 40. The contact arm assembly for each pole may be constructed in the manner disclosed in U.S. Pat. No. 3,365,561 to include movable main contacts 42 individually mounted at the ends of contact arms 42*a* which are, in turn, pivotally mounted at their other ends to a hinge pin 43. An elongated arm 44, also hinged to pin 43, carries a movable arcing contact 46 for engagement with stationary arcing contact 40. The terminal portion of arm 44 beyond arcing contact 46 is in the form of a horn 44*a* designed to assist the transfer of the arc developed during a circuit interruption to arc extinguishing structure, generally indicated at 48** in FIG. 2.

Also pivotally mounted on hinge pin 43 is a U-shaped bracket 50 which is utilized to capture a plurality of springs 52 acting on the movable contact arms **42*a*, 44 to enhance the contact pressures between the stationary and movable contacts. Brackets 50 for each of the various poles of the circuit breaker are ganged together by a cross bar 54 such that pivotal movement about hinge pins 43 of all of the movable contacts 42, 46 of the circuit breaker is in concert. This concerted movement is under the control of an operating mechanism, generally indicated at 56, which is stationed over the center pole of the circuit breaker and operatively connected to the center pole contact arm bracket 50** located therebelow.

Still referring to FIGS. 2 and 3, each hinge pin 43 is mounted to a hinge plate 58 affixed to floor **22*a* of the circuit breaker base. Current through the movable contact arms 42*a*, 44 flows into hinge plate 58, thence through an elevated busbar segment 60 embraced by a current transformer 62, and ultimately out load terminal strap 28. Current transformer 62 of each circuit breaker pole develops a signal indicative of the magnitude of current flowing in its assigned pole for processing by the electronic trip unit 36**.

The circuit breaker operating mechanism 56 of the present invention, as seen in FIG. 2, includes a pair of parallel, spaced sideplates 66 mounted to the circuit breaker base 22 and between which are, in turn, mounted the various mechanism parts. Stationed at one end of operating mechanism 56 is a latching mechanism, generally indicated at 68, functioning to latch and unlatch or trip the operating mechanism. The various parts of the latching mechanism 68 are mounted between spaced, parallel sideplates 70 secured to the mechanism sideplates 66.

Figure 4:
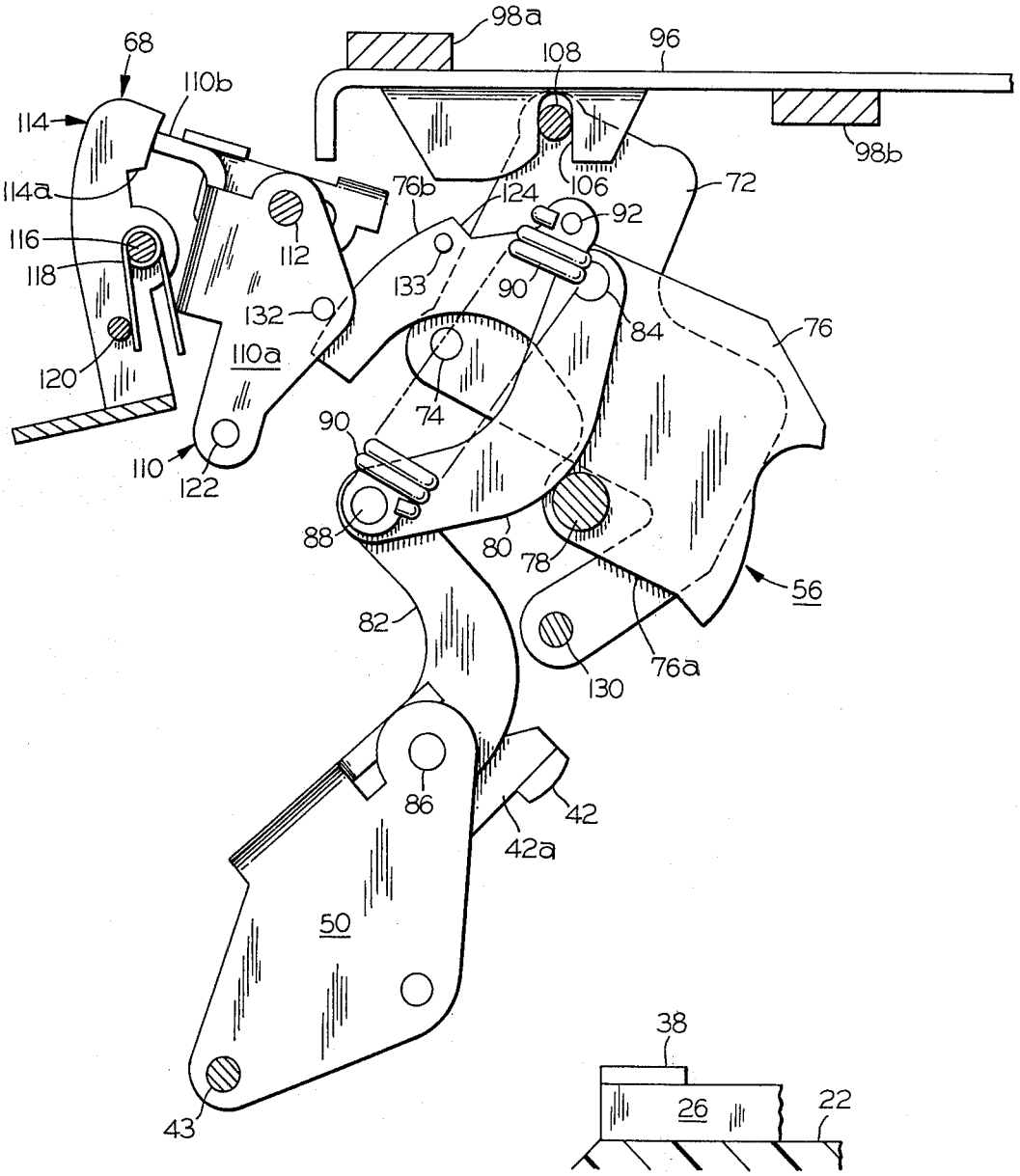
FIG. 4 is a side elevational view of the circuit breaker operating and latching mechanisms in their open conditions.
Figure 5:
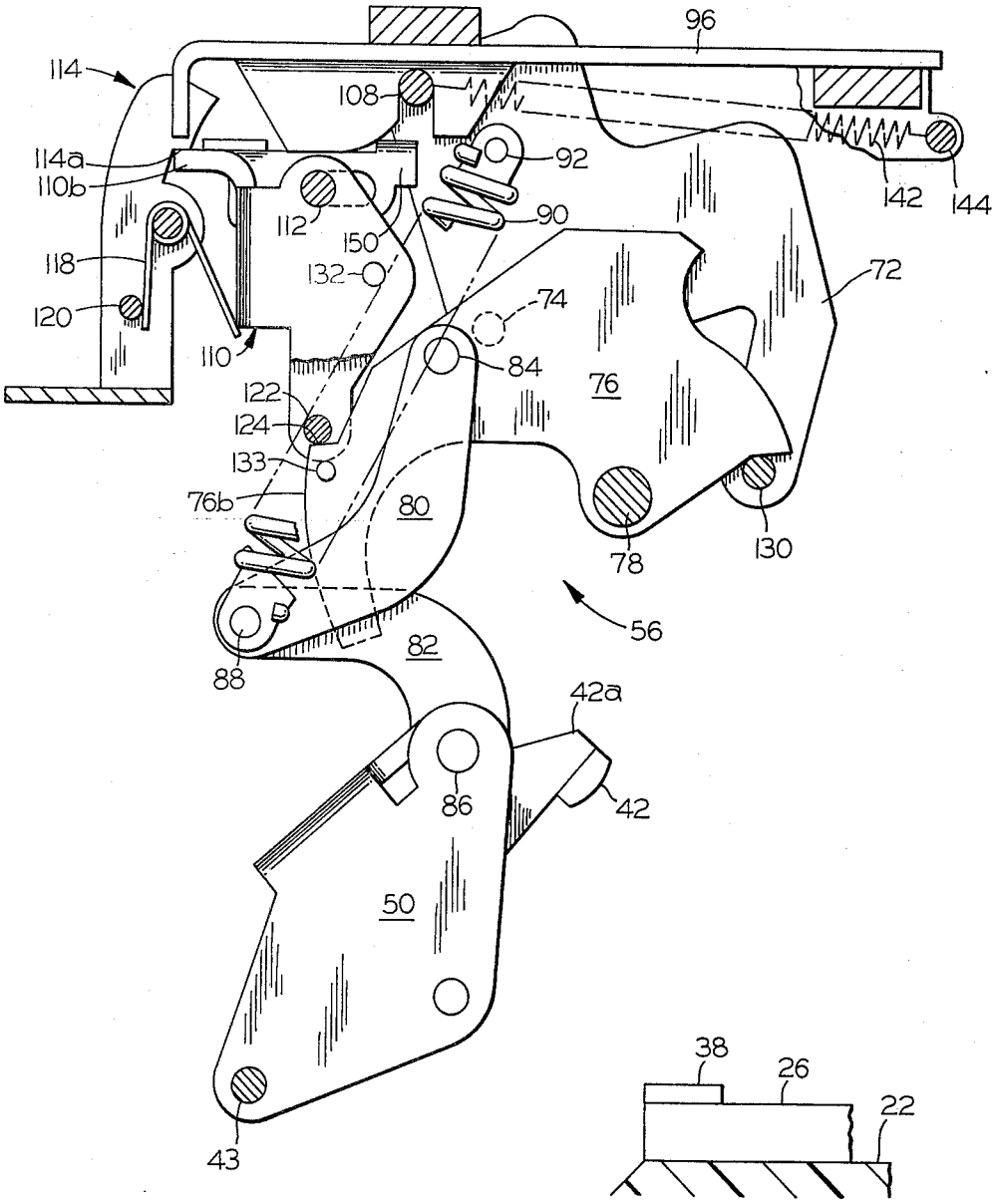
FIG. 5 is a side elevational view of the circuit breaker operating and latching mechanisms in their reset conditions.
Figure 6:
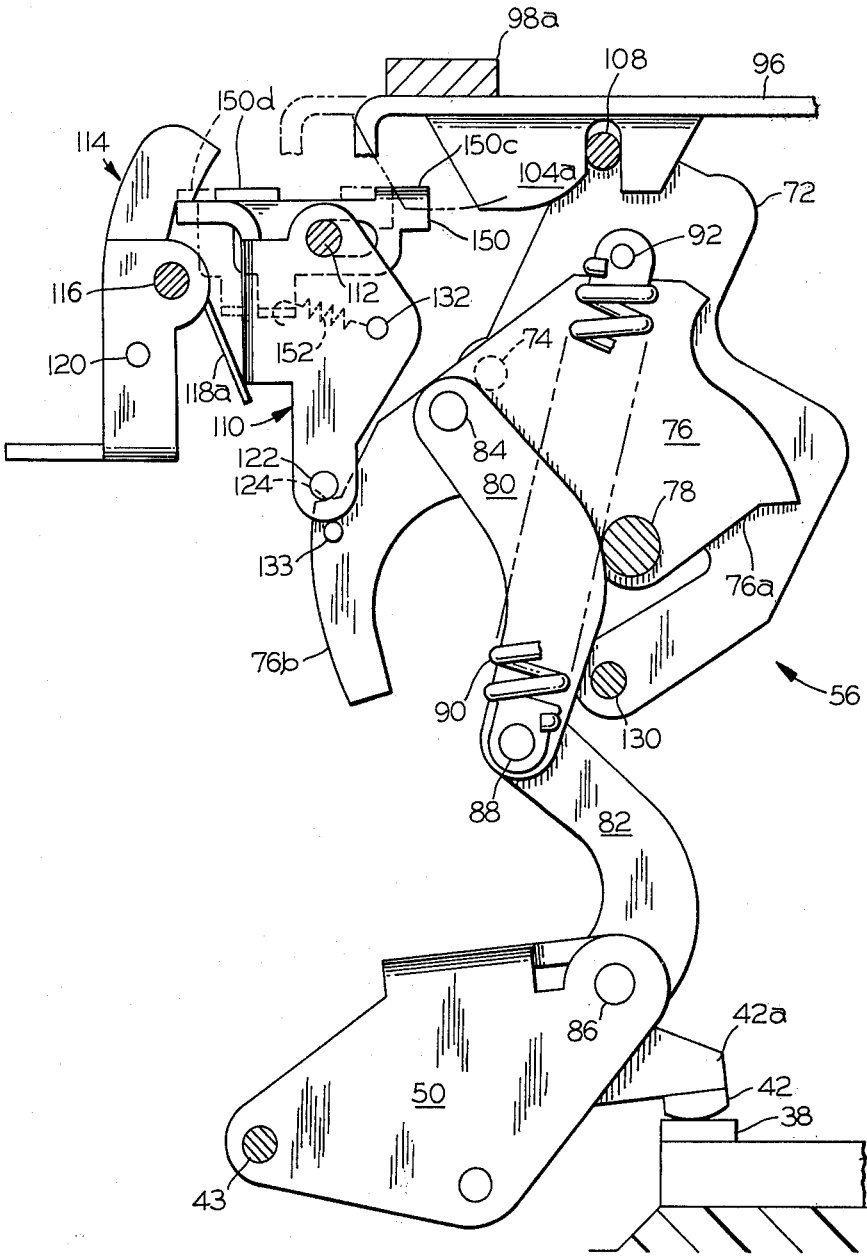
FIG. 6 is a side elevational view of the operating and latching mechanisms in their closed conditions.

The operating mechanism is best seen in FIGS. 4, 5 and 6 wherein its three basic conditions are depicted. That is, FIG. 4 shows the operating mechanism in its open condition with the movable contacts separated from the stationary contacts. FIG. 5 shows the operating mechanism in its reset condition with the circuit breaker contacts still separated. Finally, FIG. 6 shows the operating mechanism in its closed condition with the circuit breaker contacts in engagement. Referring first to FIG. 4, operating mechanism 56 includes an operating lever 72 pivotally mounted on a pin 74 supported at its ends by sideplates 66. A cradle 76 is pivotally mounted on a pin 78 likewise supported between sideplates 66. A toggle linkage consisting of an upper link 80 and lower link 82 connect cradle 76 to the center pole contact arm bracket 50. Specifically, the upper end of link 80 is pivotally connected to the cradle by a pin 84, while the lower end of link 82 is pivotally connected to the center pole bracket 50 by a pin 86. The other ends of these toggle links are pivotally interconnected by a knee pin 88. A powerful mechanism tension spring 90 acts between the toggle linkage knee pin 88 and a pin 92 affixed to operating lever 72. In practice there are two operating springs 90, one on each side of the operating mechanism, and thus to balance the spring forces on the mechanism parts, the toggle links 80 and 82 are in pairs, as is the operating lever 72. The single cradle 76 is centrally located between the paired mechanism parts.

Figure 7:
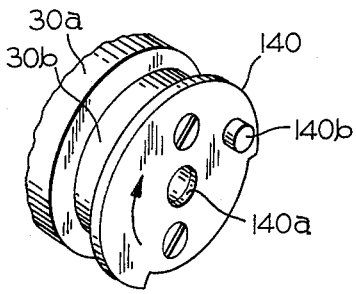
FIG. 7 is an exploded assembly view of an operating slide which couples the circuit breaker operating handle to the circuit breaker operating mechanism.
Figure 7:
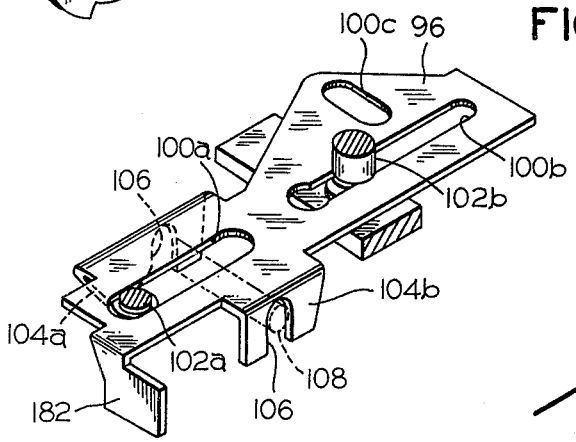

To articulate the operating mechanism, an operating slide 96, best seen in FIG. 7, is mounted for reciprocation by a pair of cross beams **98*a*, 98*b* (FIG. 4) between mechanism sideplates 66. A pair of aligned, longitudinally elongated slots 100***a*, 100*b* in slide 96, receive headed pins 102*a*, 102*b*, respectively, carried by cross beams 98*a*, 98*b* pursuant to guiding and supporting the slide in its fore and aft reciprocating movement. Side flanges 104*a*, 104*b*, depending from slide 96 are provided with downwardly open, transversely aligned slots 106 in which are received a transverse pin 108 mounted between the paired operating levers 72.

Figure 8:
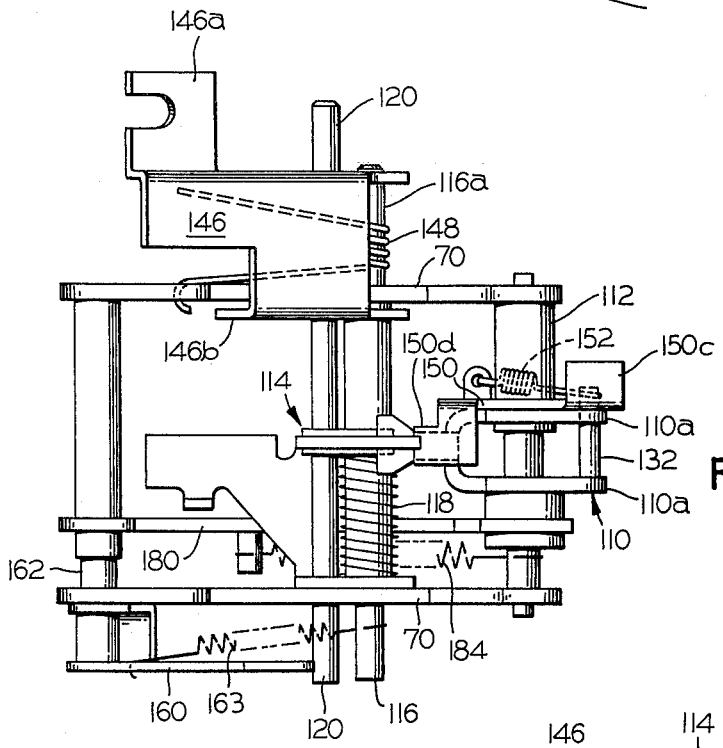
FIG. 8 is a plan view of the latching mechanism incorporated in the circuit breaker of FIG. 1.

Latch mechanism 68 includes, as best seen in FIG. 8, a U-shaped primary latch, generally indicated at 110, which is pivotally mounted on a pin 112 mounted between side plates 70. A secondary latch, generally indicated at 114, is pivotally mounted on a pin 116 supported between latch mechanism sideplates 70 (also FIG. 9). A torsion spring 118, mounted on pin 116, has one active end 118*a* biasing primary latch 110 in the counterclockwise direction about its pivot pin 112 and its other active end 118*b* acting on an elongated, transverse trip rod 120 mounted by secondary latch 114 such as to bias the latter in the clockwise direction about its pivot pin 116. The parallel, spaced side flanges of primary latch 110 constitute primary latch levers 110*a* which serve to mount between their lower ends a transverse latch pin 122. As best seen in FIGS. 5 and 6, latch pin 122 engages a latch shoulder 124 carried by cradle 76 to releasably retain the operating mechanism 56 in its reset and ON conditions. To sustain this primary latching engagement, a latch tip 110*b* turned out from the bight of primary latch 110 is engaged under a latching shoulder 114*a* provided in secondary latch 114.

Articulation of the operating mechanism 56 from its OFF condition of FIG. 4 to its reset condition of FIG. 5 is effected by movement of slide 96 to the left. The paired operating levers 72 are rotated in a counterclockwise direction about its pivot pin 74 via the drive coupling of operating lever pin 108 in slide slot 106. A transverse pin 130 mounted between the lower extremities of operating levers 72, after some free travel, engages a lower camming edge 76*a* of cradle 76, and thereafter the cradle and operating levers are commonly rotated in the counterclockwise direction. An arcuate edge 76*b* formed on cradle 76 leading up to its latching shoulder 124 bears against a pin 132 mounted between primary latch levers 110*a* to sustain the unlatching position of the primary latch illustrated in FIG. 4 during cradle rotation. When cradle arcuate edge 76*b* clears pin 132, a transverse pin 133, carried by the cradle, engages the primary latch to temporarily sustain its unlatching position against the bias of spring 118 until edge 76*b* engages latch pin 122. While cradle 76 is being carried around in the counterclockwise direction by operating levers 72, the toggle linkage is further collapsed as the lower link 82 pivots in a counterclockwise direction about its pivot pin 86, while upper link 80 pivots in the clockwise direction about its pivot pin 84. It is seen that this causes a generally downward movement of the toggle linkage knee pin 88 along an arcuate path whose center is pin 86. At the same time, pin 92 carried by the operating levers 72 moves upwardly and to the left along an arcuate path about pin 74. Consequently, the separation between knee pin 88 and pin 92 is significantly increased during this resetting, counterclockwise motion of the operating levers and cradle induced by leftward movement of slide 96. Since these pins are the anchor points for the mechanism springs 90, loading of the mechanism springs is effected during resetting of the operating mechanism.

Once cradle edge 76*b* clears latch pin 122, spring 118 rocks the primary latch counterclockwise to bring the latch pin into latching engagement with latch shoulder 124 at the culmination of the leftward movement of slide 96. The counterclockwise rotation of primary latch 110 incident to latch pin 122 riding onto cradle shoulder 124 ducks its latch tip 110*b* sufficiently downward such that secondary latch 114 can be rotated clockwise by its spring 118 to bring secondary latch shoulder 114*a* into overlying latching engagement with the latch tip. This brings the operating mechanism 56 to its reset condition as illustrated in FIG. 5.

While in this reset condition, it is seen that the toggle linkage is completely collapsed and the contact arm brackets 50 remain elevated such that the circuit breaker contacts are still separated. To close the circuit breaker contacts, the slide 96 is returned to the right to articulate the operating mechanism to its ON condition shown in FIG. 6. Since the cradle is latched by the latching mechanism 68, its position remains unchanged. However, operating levers 72 are rotated in a clockwise direction about their pivot pin 74. During this clockwise movement, it is seen that pin 92 to which the upper ends of mechanism springs 90 are anchored is progressively moved to the right. When the line of action of these mechanism springs 90 moves to the right of pin 84 to which the upper links 80 of the toggle linkage are pivotally connected, the mechanism springs become effective to abruptly straighten the toggle linkage, resulting in abrupt clockwise rotation of the contact arm brackets 50 and consequent quick closure of the circuit breaker contacts.

From the description thus far, it is seen that the operating mechanism is articulated from its contact open condition to its reset condition and thence to its contact closed condition by a single reciprocation of the operating slide 96. It is also important to note that the straightening of the toggle linkage incident to closure of the circuit breaker contacts is arrested just short of the fully straightened condition by engagement of the upper links 80 with the cradle pivot pin 78. Thus, pivot pin 78 acts as a stop to prevent the toggle linkage from snapping through to an oppositely, partially collapsed condition as has traditionally been the case. Thus, engagement of upper links 80 with pivot pin 78 maintains the toggle linkage in a partially collapsed condition such that the operating springs 90 acting via the upper toggle links bias the cradle 76 in the clockwise direction; movement of the cradle in this direction being inhibited as long as primary latch pin 122 engages cradle shoulder 124. Since the toggle linkage is not snapped through its fully straightened condition during tripping of the circuit breaker, opening of the contacts is achieved that much more rapidly. That is, the initial movement of the toggle linkage upon release of the cradle by the latching mechanism starts its collapse, and thus contact separation is initiated without hesitation. In fact, under high fault conditions, contact separation may be initiated by the electromagnetic forces associated with the high fault currents prior to release of the cradle. It is seen that the toggle linkage can accommodate this initial, forced contact separation by immediately beginning its collapse, and the cradle, upon its release, catches up with the collapsing toggle linkage in completing the interruption without contact reclosure.

To trip the circuit breaker, secondary latch 114 is rocked in the counterclockwise direction about its pivot pin 116 to release primary latch 110. The primary latch is thus free to pivot about its pivot pin 112 in the clockwise direction under the urgence of mechanism springs 90. Primary latch pin 122 is thus forced off cradle shoulder 124, and the cradle is freed for movement in the clockwise direction about its pivot pin 78 by the mechanism springs. By virtue of the engagement of upper links 80 with cradle pivot pin 78, both the cradle and the upper links pivot in unison about this pivot pin, thereby accelerating the rate of collapse of the toggle linkage. This produces abrupt separation of the circuit breaker contacts as the contact arm brackets 50 are pivoted upwardly about their hinge pins 43 by the rapidly collapsing toggle linkage. Also contributing to the rapid rate of contact separation is the fact that, as the toggle linkage is collapsing, the line of action of the mechanism springs moves away from the cradle pivot pin 78. This increasing leverage compensates for the reducing spring forces generated by the mechanism springs 90 as they approach their unloaded conditions. It will be noted that the position of the operating levers 72 during tripping of the circuit breaker remains unchanged as the other parts of the operating mechanism articulate from their closed circuit condition of FIG. 6 to their open circuit condition of FIG. 4. The mechanism springs, which constitute the sole coupling between the operating levers and the remaining mechanism parts during a tripping operation, largely absorb the energies released.

Figure 10:
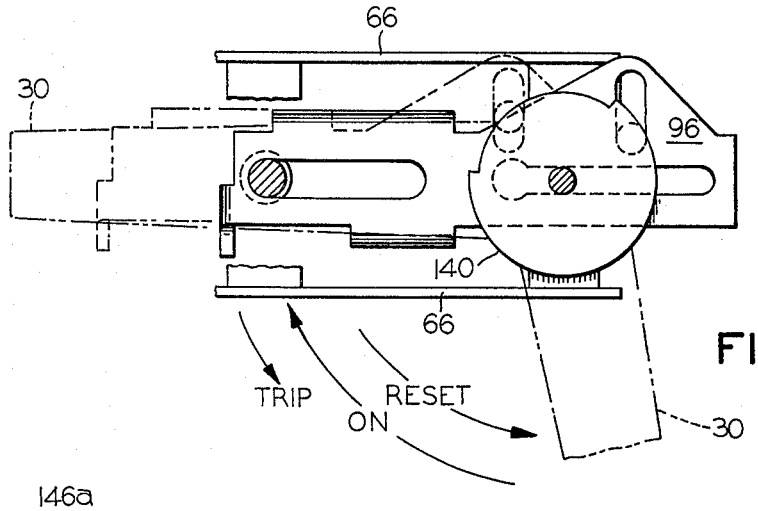
FIG. 10 is a fragmentary plan view illustrating the motions of the slide and operating handle of FIG. 7 pursuant to articulating the circuit breaker operating mechanism.

Reciprocation of slide 96 to articulate the operating mechanism 56 is facilitated by the rotary handle 30. As best seen in FIG. 7, hub 30*a* of the rotary handle is provided with a reduced diameter terminal portion 30*b* which is received in a close fitting opening (not shown) formed in cover 24. A drive plate 140 is affixed to the butt end of the hub and has a larger diameter than the terminal portion 30*b* such that the rotary handle is captured in the circuit breaker cover 24. The drive plate is provided with a central opening 140*a* and an offset depending drive post 140*b*. With cover 24 in place, upstanding pin 102*b* operating in slide slot 100*b* is received in drive plate opening 140*a*, while drive post 140*b* is received in an offset, transversely elongated slot 100*c* formed in slide 96 (see FIG. 10). It is thus seen that rotation of the rotary handle about pin 102*b* in the clockwise direction seen in FIG. 10, a mere 120° forces slide 96 to the left by virtue of the driving engagement of drive post 140*b* in slot 100*c*. Return of the handle in the clockwise direction to its home position reciprocates the slide to the right, back to its home position to complete a full slide reciprocation. As seen in FIG. 5, a pair of handle return springs 142 acting between a fixed post 144 and pin 108 carried by operating levers 72 insure that the handle and slide are fully returned to their home position.

Figure 9:
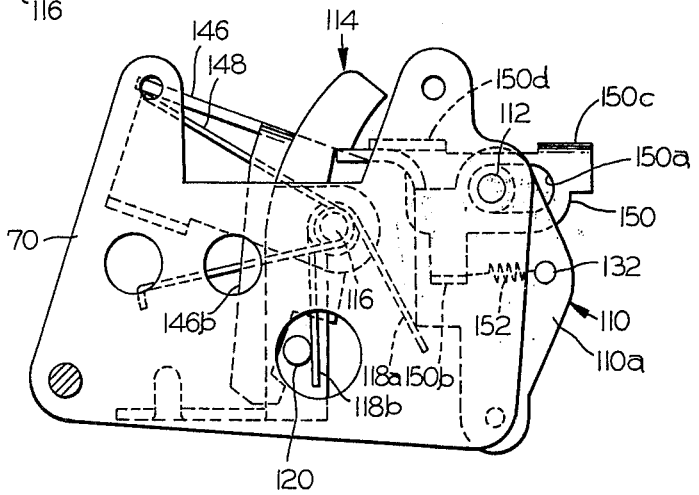
FIG. 9 is a side elevational view of the latching mechanism of FIG. 8.

Referring now to FIGS. 8 and 9, latching mechanism 68 further includes a manual trip lever 146 pivotally mounted on an extension 116*a* of secondary latch pivot pin 116 beyond one sideplate 70. A torsion spring 148 mounted on pin extension 118*a* has one end hooked in the latching mechanism sideplate 70 and the other end acting against the under side of trip lever 146 such as to bias the lever in the clockwise direction seen in FIG. 9. A lateral extension 146*a* of manual trip lever 146 is stationed under the manual trip button 34 (FIG. 1), such that depression of the trip button rocks the trip lever in the counterclockwise direction. A pendant leg 146*b* of manual trip lever 146 is positioned between the latching mechanism sideplates 70 poised to engage trip rod 120 mounted by secondary latch 114. It is thus seen from FIG. 9 that rotation of the manual trip lever 146 in the counterclockwise direction causes its leg 146*b* to impact trip rod 120 and rock secondary latch 114 counterclockwise to release primary latch 110. Cradle 76 is thus released, and the circuit breaker trips.

In addition to manual tripping of the circuit breaker by the trip button 34, the latching mechanism also includes provisions to permit manual tripping of the circuit breaker by the rotary handle 30. To this end, a handle trip slide 150 is mounted to operate in conjunction with primary latch 110. Specifically referring to FIGS. 9 and 10, handle trip slide 150 includes an elongated slot 150*a* through which the primary latch pivot pin 112 extends. A spring 152 acting between a depending tab portion 150*b* of trip slide 150 and pin 132 carried by primary latch 110 urges the handle trip lever rightward to a retracted position. The left end of handle trip slide 150 includes a laterally turned actuating tab 150*c*. The other end of trip slide 150 includes an oppositely turned tripping tab 150*d* which rests atop latch tip 110*b* of primary latch 110. From FIG. 6, it is seen that when primary latch 110 is latching up cradle 76 and, in turn, is latched by secondary latch 114, tab 150*c* of the handle trip slide 150 is in position to be engaged by the leading sloping edge of flange 104*a* depending from slide 96. Consequently, if the handle 30 is then rotated toward its reset position, the slide is moved to the left and this leading edge of the flange engages the tab 150*c*, pushing the trip slide to the left such that its tab 150*d* knocks the secondary latch out of latching engagement with the primary latch. The circuit breaker is thus tripped. It will be seen from FIG. 4 that while the primary latch is in its unlatching position, actuator tab 150*c* of handle trip slide 150 is ducked down below flange 104*a* of slide 96. Consequently, the handle trip slide does not interfere with resetting of the circuit breaker. Also, from FIG. 5, it is seen that trip slide 150 is simply rocked about pin 112 by the arcuate trailing edge of slide 104*a*, so as not to interfere with the return of slide 96 to the right incident to closing the circuit breaker contacts.

Figure 11:
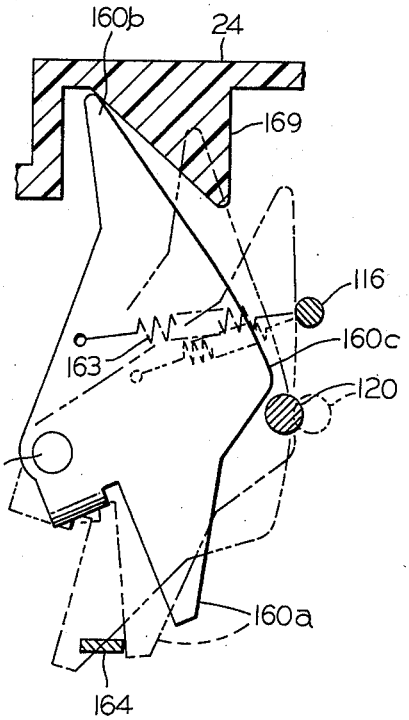
FIG. 11 is a fragmentary side elevational view of a trip interlock incorporated in the latching mechanism of FIG. 8.
Figure 14:
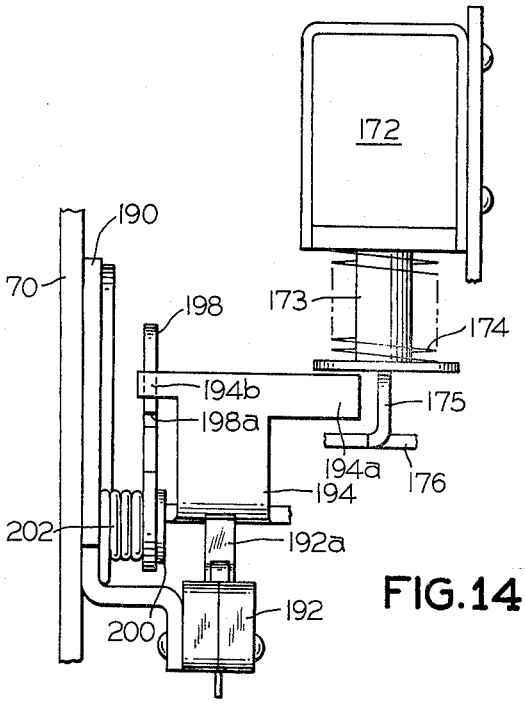
FIG. 14 is a fragmentary end view of a portion of the latching mechanism of FIG. 8 as equipped with a bell alarm switch and lockout accessory.

Latching mechanism 68 of FIGS. 2 and 8 also includes a dual trip interlock, generally indicated at 160 in FIG. 11, which responds to displacement of circuit breaker cover and/or trip unit 36 by tripping the circuit breaker if it is ON and, if the circuit breaker is OFF, disabling the secondary latch 114 such that the circuit breaker cannot be reset in the absence of the static trip unit and/or cover. This trip interlock is in the form of a lever pivotally mounted intermediate its ends on the outer extension of a pin 162 mounted by the latching mechanism sideplates 70. A spring 163 connected between the trip interlock lever 160 and the secondary latch pivot pin 116 biases the trip interlock in the clockwise direction seen in FIG. 11. The lower end of the trip interlock lever is in the form of a sensing finger 160*a* which is arranged to engage a stop 164 extending from one of the mounting brackets 166 for electronic trip unit 36, as seen in FIG. 2. The upper end of the interlock lever is in the form of a second sensing finger 160*b* which is acted upon by a projection 169 depending from the underside of cover 24. With cover 24 in place, the trip interlock is forced by projection 169 to assume its solid line position seen in FIG. 11, where it is in disengaging relation with trip rod 120 carried by secondary latch 114. When cover 24 is removed, spring 163 rocks the trip interlock lever 160 to its intermediate phantom line position with the lower sensing finger 160*a* abutting stop 164 carried by the electronic trip unit bracket 166. In this intermediate position, the nosed edge surface 160*c* of the trip interlock lever engages and shifts trip rod 120 to its phantom position seen in FIG. 11. Secondary latch 114 is thus rocked in a counterclockwise direction to unlatch primary latch 110 and trip the breaker in the event it had not previously tripped. It will be appreciated that with the trip rod 120 held in its phantom line position by trip interlock lever 160, resetting of the operating mechanism 56 incident to reclosure of the circuit breaker is inhibited. If the cover 24 is replaced, while the electronic trip unit 36 is in position, the ramp surface 169*a* of cover projection 169 engages upper sensing finger 160*b*, camming the trip interlock 160 back to its solid line position of FIG. 11. Trip rod 120 is thus released to remove the disablement of secondary latch 114, and the circuit breaker can now be reclosed.

If trip unit 48 is removed from the circuit breaker case, stop 164 is no longer present to limit clockwise rotation of trip interlock lever 162 to its intermediate phantom line position seen in FIG. 11. Spring 163 thus rotates the trip interlock lever around to its extreme clockwise phantom line position where it abuts against the secondary latch pivot pin 116. The nosed edge 160*c* of the trip interlock lever is contoured such that secondary latch disabling engagement with trip rod 120 is maintained while the interlock lever is in the extreme clockwise position. It will be appreciated that with electronic trip unit 36 removed, the circuit breaker is no longer capable of automatic overcurrent protection, and thus it is extremely important that the circuit breaker can never be put into service without the trip unit being installed. To this end, it is seen that the upper sensing finger 160*b* is rotated beyond projection 169 while the trip interlock lever 160 is in its extreme clockwise position, and thus cannot be cammed back to its counterclockwise position simply by replacement of cover 24. Consequently, in the absence of the trip unit, disablement of the secondary latch is continued, and the circuit breaker cannot be inadvertently reclosed.

Figure 12:
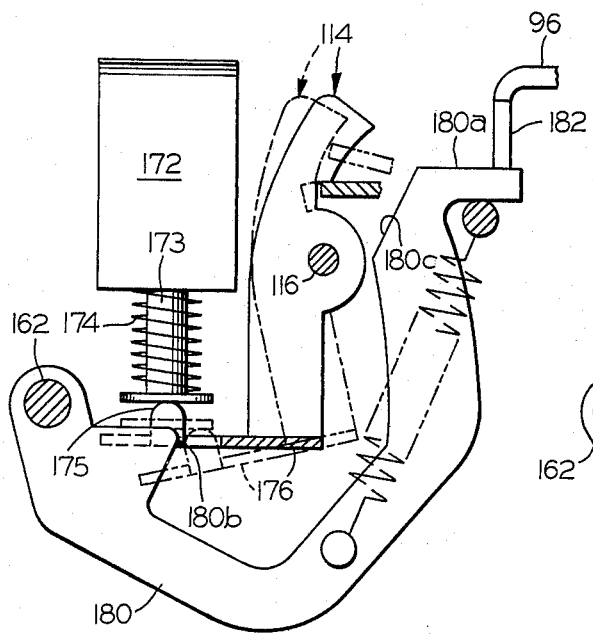
FIG. 12 is a fragmentary side elevational view of a portion of the latching mechanism of FIG. 8 illustrating the manner in which a trip solenoid acts to trip the circuit breaker.
Figure 13:
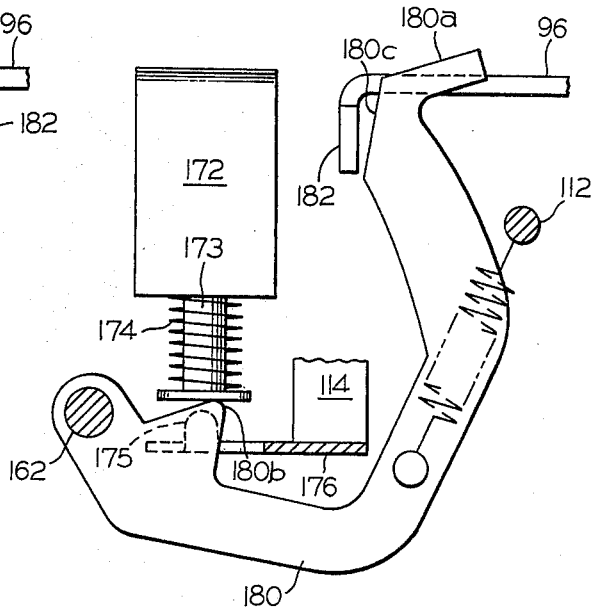
FIG. 13 is a fragmentary side elevational view illustrating the manner in which the trip solenoid of FIG. 12 is reset incident to resetting of the circuit breaker operating mechanism.

Automatic circuit protection is afforded by the electronic trip unit 36 which processes the signals received from the current transformers 62 in each pole of the circuit breaker and, for pre-selected current overload conditions, energizes a trip solenoid 172 (FIG. 2) to trip the circuit breaker. This trip solenoid, as best seen in FIGS. 12 and 13, is preferably of the known flux shifter type, which includes a plunger 173 which is held in its retracted, upward position against the bias of a spring 174 by holding flux generated by a permanent magnet (not shown). The lower flanged end of plunger 173 is stationed immediately above an upwardly extending tab 175 carried by an elongated arm 176 extending laterally from the lower end of secondary latch 114. A coil (not shown) within the flux shifter is energized from the electronic trip unit 48 to develop a bucking flux which renders the holding flux incapable of maintaining the plunger in its retracted position. Consequently, spring 174 urges the plunger 173 downward into impact with tab 175 carried by secondary latch 114. The secondary latch is thus rocked counterclockwise about its pivot pin 116, releasing the primary latch 110 to trip the circuit breaker.

Before the circuit breaker can be reclosed, the solenoid plunger 173 must be returned to its retracted position to enable the holding flux generated by the permanent magnet to again overpower the plunger spring 174 and maintain the plunger retracted in the absence of coil generated bucking flux. To reset flux shifter 172 incident to resetting of the circuit breaker mechanism 56, an elongated reset lever 180 is pivotally mounted at one end on pin 162. The other end of this reset lever is positioned so as to be acted upon by a turned-down tab 182 situated at the left end of slide 96 (also FIG. 7). A spring 184 acting between reset lever 180 and the pivot pin 112 for primary latch 110 (also FIG. 8) biases the reset lever in the counterclockwise direction about its pivot pin 162. While slide 96 is in its rightmost, home position, it is seen that tab 182 bears against the upper terminal edge portion 180*a* of reset lever 180 to maintain it in its counterclockwise, depressed position against the bias of spring 184. In this position, a nosed edge portion 180*b* of the reset lever is spaced below the flanged end of plunger 173 while in its retracted position. Thus, the plunger is afforded sufficient travel in which to act upon the secondary latch 114 for the purpose of automatically tripping the breaker. When the operating mechanism 56 is reset by rotation of handle 30 through its 120 degree arc, tab 182 of slide 96 moves to the left, as seen in FIG. 13, thereby releasing reset lever 180. Spring 184 is thus free to rock the reset lever in a counterclockwise direction, raising its nosed edge 180*b* upwardly to drive the plunger 173 back to its retracted position. Once the operating mechanism is reset, and the slide 96 is returned to its home position to turn the circuit breaker on, tab 182 engages angular edge portion 180*c* of reset lever 180, thereby rotating it back around to its position shown in FIG. 12, a position thereafter sustained by engagement of slide tab 182 with terminal edge surface 180*a*. As a consequence, the flux shifter 172 is reactivated, and the nosed edge portion 180*b* at reset lever 180 is ducked down sufficiently to allow plunger 173 to trippingly engage secondary latch 114.

Figure 15:
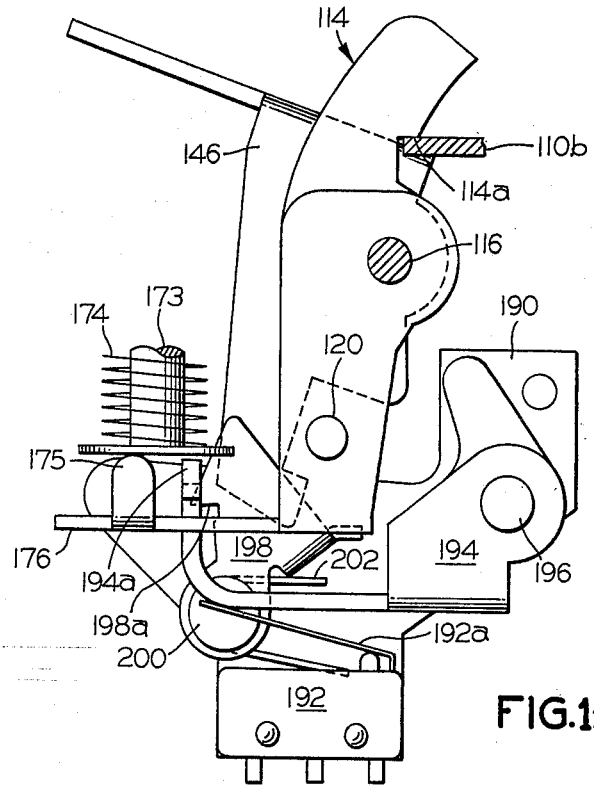
FIG. 15 is a fragmentary side elevational view of the accessory of FIG. 14.
Figure 16:
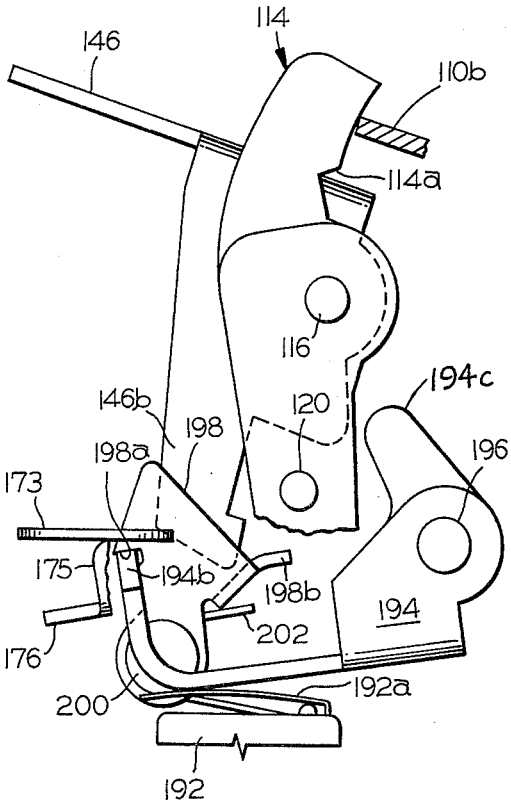
FIG. 16 is a side elevational view of the accessory of FIG. 14 in its circuit breaker lockout condition.
Figure 17:
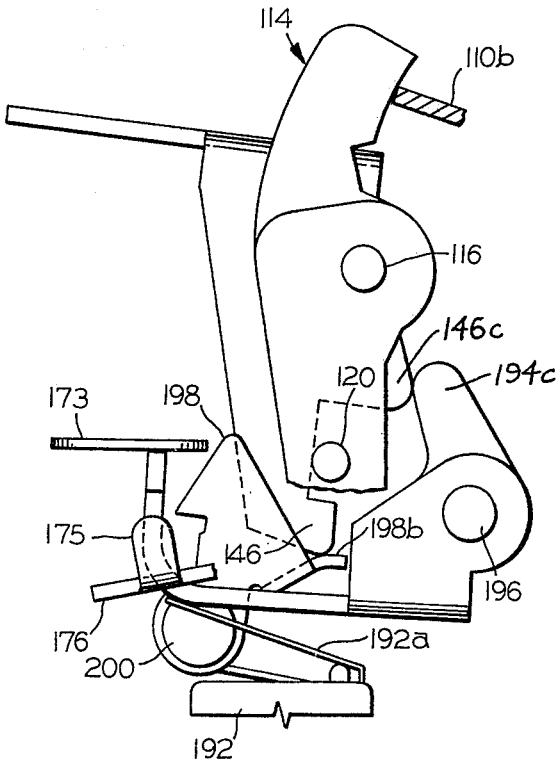
FIG. 17 is a fragmentary side elevational view of the accessory of FIG. 14 illustrating the manner in which the circuit breaker lockout is defeated.

FIGS. 14 through 17 disclose a bell alarm switch and breaker lockout accessory for implementation in the latching mechanism 68. This accessory includes a bracket 190 for mounting attachment to one of the latching mechanism sideplates 70. This bracket carries at its lower offset end portion a bell alarm switch 192. A lockout lever 194 is pivotally mounted on a pin 200, also mounted by bracket 190. A torsion spring 202, carried by pin 200, biases latch lever 198 in the counterclockwise direction, as seen in FIGS. 15–17.

Lockout lever 194 has its free end turned upwardly to locate an arm 194*a* for lateral extension into overlying relation with arm 176 carried by secondary latch 114. Lockout lever 194 also carries at its turned-up free end a laterally extending tab 194*b* positioned to be latchably engaged by latch lever 198.

From the description thus far, it is seen that when flux shifter 172 is energized from the static trip unit 36, thereby releasing plunger 173 for movement to its extended position under the urgency of its spring 174, the plunger not only impacts the secondary latch to trip the breaker, but also impacts lever arm 194*a* and depresses lockout lever 194. Thus depressed, its tab 194*b* falls below the latching shoulder 198*a* carried by latch lever 198. Spring 202 rocks the latch lever counterclockwise to bring its shoulder 198*a* into overlying relation with lockout lever tab 194*b*, thereby sustaining the depressed position of lockout lever 194 (FIG. 16). In this depressed position, lockout lever arm 194*a* is effective through its engagement with secondary latch arm 76 to hold the secondary latch in its counterclockwise disabled position such that the breaker cannot be reclosed. Also, in its depressed position, the underside of the lockout lever engages an actuating arm 192*a*, closing the bell alarm switch to complete an alarm circuit which sounds to signal that the circuit breaker has been tripped automatically via flux shifter 172. It will be noted that the bell alarm and lockout accessory is not operative upon manual tripping of the circuit breaker since, on these occasions, the flux shifter 172 does not operate.

To defeat breaker lockout and open bell alarm switch 192, manual trip lever 146 is actuated by the trip button 34. As the trip lever 146 is pivoted counterclockwise, seen in FIGS. 16 and 17, its pendant leg 146*b* engages a laterally turned tab 198*b* carried by latch lever 198. Full counterclockwise rotation of trip lever 146 first rocks latch lever 198 clockwise out of latching engagement with lockout lever 194. Then, a nosed edge portion 146*c* of the tripping lever acts against an arm 194*c* integral with the lockout lever (FIG. 17) to pivot the lockout lever clockwise and force plunger 173 upward to its retracted position, resetting the flux shifter 172. The switch actuator spring 192*a* now holds the lockout lever 194 in this elevated position as the trip lever 146 is released. The latch lever is then pivoted by its torsion spring 202 counterclockwise to bring its angular front edge 198*b* into engagement with lockout lever arm 194*b*. The latch lever is thus poised to relatch the lockout lever while presenting a negatively biased surface to hold the locking lever 194 upward against the end of plunger 173. Thus, minimal additional restricting force is applied to the flux shifter plunger as it operates to trip the circuit breaker. The trip lever 146 is thus utilized both to defeat the breaker lockout and reset the flux shifter; the latter being required so that the lockout lever can be pivoted to its elevated position where it can not be relatched by the latch lever. It is seen that, if the flux shifter is not reset by operation of trip lever 146, its plunger 173 will detain the lockout lever in its depressed position where it can be relatched by the latch lever when the trip lever is released. Consequently, the circuit breaker could not be reset until the flux shifter is reset via the rotary operating handle 30, slide 96 and reset lever 180, and the trip lever 146 would then have to be operated to defeat the breaker lockout by unlatching the lockout lever. Only then is the rotary handle capable of resetting the circuit breaker.

It will thus be seen that the objects set forth above, among those made apparent in the preceding description, are efficiently attained and, since certain changes may be made in the above construction departing from the scope of the invention, it is intended that all matter contained in the above description or shown in the accompanying drawings shall be interpreted as illustrative and not in a limiting sense.

Having described our invention, what we claim as new and desire to secure by Letters Patent is:

1. A multi-pole circuit breaker comprising, in combination:

A. a support;

B. a plurality of stationary contacts mounted by said support;

C. a plurality of movable contact arms pivotally mounted by said support, 1. each said arm carrying a movable contact, and
2. said arms ganged together for conjunctive pivotal movement between a common open circuit position and a common closed circuit position with said movable contacts electrically engaging corresponding stationary contacts;

D. a frame mounted by said support;

E. a cradle pivotally mounted by said frame for movement between reset and released positions;

F. a toggle linkage interconnecting said cradle and contact arms, 1. said toggle linkage including first and second links pivotally interconnected by a knee joint, and
2. said toggle linkage maintaining said contact arms in their open circuit position while collapsed and pivoting said contact arms to their closed circuit position when straightened;

G. a latching mechanism for latchably engaging said cradle as it is pivoted to its reset position;

H. an operating lever pivotally mounted by said frame, said lever drivingly engaging said cradle upon pivotal movement in a forward direction to pivot said cradle to its reset position;

I. a spring connected between said operating lever and said knee joint, said spring being progressively rotated as said lever is pivoted in its forward direction;

J. a reciprocating slide mounted by said frame, said slide coupled to pivot said lever in its forward direction and said cradle to its reset position during a forward slide stroke and to pivot said lever in a return direction enabling said spring to straighten said toggle linkage during a return slide stroke;

K. a rotary handle mounted by said support and drivingly connected to said slide, said handle driving said slide through its forward stroke during a forward handle crank and driving said slide through its return stroke during a return handle crank.

2. The circuit breaker defined in claim 1, wherein said slide includes means forming an elongated drive slot extending transversely to the direction of reciprocating slide movement, and said handle includes an eccentric post engaged in said drive slot.

3. The circuit breaker defined in claim 2, wherein said slide further includes means forming a pair of elongated, longitudinally aligned guide slots therein, and a pair of guide pins mounted by said frame and engaged in said guide slots to guide said slide in its reciprocating movement, said handle including means forming a central opening in which one of said guide pins is engaged.

4. The circuit breaker defined in claim 2, wherein said slide includes a depending flange, means forming a downwardly opening slot in said flange, and a pin mounted by said operating lever and engaged in said flange slot.

5. The circuit breaker defined in claim 1, wherein said latching mechanism includes pivotally mounted primary and secondary latches, said primary latch engaging a catching shoulder carried by said cradle to latchably retain the latter in its reset position, said secondary latch engaging said primary latch to latchably retain the latter in latching engagement with said cradle shoulder.

6. The circuit breaker defined in claim 5, wherein said cradle includes means engaging said primary latch to control its position during pivotal movement of said cradle toward its reset position.

7. The circuit breaker defined in claim 5, which further includes an external manual trip button mounted by said support, and said latching mechanism further includes a manual lever mounted to be pivoted into tripping engagement with said secondary latch by depression of said trip button, whereby said secondary latch unlatches said primary latch which, in turn, unlatches said cradle.

8. The circuit breaker defined in claim 5, wherein said latching mechanism further includes a handle trip slide mounted by said primary latch, said operating slide including means operative incident with movement of said operating slide in its forward direction while said primary and secondary latches are latchably engaged to move said trip slide into tripping engagement with said secondary latch and thereby defeat its latching engagement with said primary latch.

9. The circuit breaker defined in claim 1, wherein said latching mechanism further includes a shunt trip solenoid having a plunger normally held in a retracted position against the bias of a plunger spring, said plunger movable by said plunger spring to an extended position, trippingly engaging said secondary latch and thus unlatch said cradle.

10. The circuit breaker defined in claim 9, wherein said latching mechanism further includes a pivotally mounted reset lever, said slide including means controlling said reset lever to return said solenoid plunger to its retracted position incident to a forward slide stroke.

* * * * *

UNITED STATES PATENT OFFICE

CERTIFICATE OF CORRECTION

PATENT NO. : 4,001,742

DATED : January 4, 1977

INVENTOR(S) : Charles L. Jencks and Roger N. Castonguay

It is certified that error appears in the above-identified patent and that said Letters Patent are hereby corrected as shown below:

Column 12, line 64 change "catching" to -- latching --

Column 13, line 8 after "manual" insert the word -- trip --

Signed and Sealed this

Fifth Day of April 1977

[SEAL]

*Attest:*

RUTH C. MASON
*Attesting Officer*

C. MARSHALL DANN
*Commissioner of Patents and Trademarks*